US008702017B2

(12) United States Patent
Chow et al.

(10) Patent No.: US 8,702,017 B2
(45) Date of Patent: Apr. 22, 2014

(54) NOZZLE DEVICE EMPLOYING HIGH FREQUENCY WAVE ENERGY

(75) Inventors: Lap Kei Eric Chow, Kowloon (HK); Hoi Shuen Tang, Kwai Chung (HK); Hon Keung Lai, Ma On Shan (HK); Chi Wah Cheng, Tsing Yi (HK)

(73) Assignee: ASM Assembly Automation Ltd, Hong Kong (HK)

( * ) Notice: Subject to any disclaimer, the term of this patent is extended or adjusted under 35 U.S.C. 154(b) by 956 days.

(21) Appl. No.: 12/335,675

(22) Filed: Dec. 16, 2008

(65) Prior Publication Data

US 2010/0150756 A1 Jun. 17, 2010

(51) Int. Cl.
*B05B 1/08* (2006.01)

(52) U.S. Cl.
USPC ..... 239/102.2; 239/102.1

(58) Field of Classification Search
CPC ..... B05B 17/0607; B05B 17/06
USPC ..... 239/102.1, 102.2; 134/155, 184, 198
See application file for complete search history.

(56) References Cited

U.S. PATENT DOCUMENTS

| | | | | |
|---|---|---|---|---|
| 4,533,082 | A * | 8/1985 | Maehara et al. | 239/102.2 |
| 4,702,418 | A * | 10/1987 | Carter et al. | 239/101 |
| 5,927,306 | A | 7/1999 | Izumi et al. | |
| 6,039,059 | A * | 3/2000 | Bran | 134/105 |
| 6,116,517 | A * | 9/2000 | Heinzl et al. | 239/101 |
| 6,247,525 | B1 * | 6/2001 | Smith et al. | 165/104.25 |
| 6,305,617 | B1 * | 10/2001 | Yu | 239/102.1 |

FOREIGN PATENT DOCUMENTS

JP 2003-340330 12/2003

* cited by examiner

*Primary Examiner* — Davis Hwu
(74) *Attorney, Agent, or Firm* — Ostrolenk Faber LLP

(57) ABSTRACT

A nozzle device comprising a nozzle chamber includes a fluid inlet located at a first side of the nozzle chamber which is operative to introduce fluid into the nozzle chamber in an injection direction and a fluid outlet at a second side of the nozzle chamber which is operative to expel fluid from the nozzle chamber. A high frequency wave generator is also located in the nozzle chamber which is oriented and operative to generate high frequency waves in a direction which is substantially parallel to the injection direction, whereby to impart high frequency energy to the fluid in the nozzle chamber.

12 Claims, 2 Drawing Sheets

NOZZLE DEVICE EMPLOYING HIGH FREQUENCY WAVE ENERGY

FIELD OF THE INVENTION

The present invention relates to a nozzle for cooling, cleaning and lubricating working surfaces, and in particular, to a nozzle comprising a fluid jet system employing high frequency energy waves to energize the fluid.

BACKGROUND AND PRIOR ART

Some nozzle devices may comprise a piezoelectric actuator which transforms electrical energy to mechanical energy in the form of high frequency waves, such as megasonic waves of acoustic vibrational frequencies in the mega-hertz range. Megasonic waves are highly focused in nature. This vibrational energy actuates a working fluid to enhance the energy of the working fluid which when directed at a working surface by a nozzle increases the effectiveness of the working fluid for cooling, cleaning and/or lubricating the working surface.

For example, when nozzle devices energized by megasonic waves are applied in precision machining, the machining performance is improved when the energized working fluid reaches the proximity of a cutting point. As a result, this increases the cooling and lubricating performance of the working fluid.

In another application, such nozzle devices are useful for cleaning semiconductor devices which must be thoroughly cleaned to remove microscopic debris before subjecting them to downstream fabrication processes. Contaminant particles of sizes in the submicron range can be removed from the surface of a semiconductor device when a drag force is exerted on the contaminant particles causing these particles to oscillate.

A conventional nozzle device 100 is illustrated in FIG. 1, which comprises a piezoelectric actuator 102 located at the rear of the device 100 along a principal axis P of the device 100. High frequency waves such as megasonic or ultrasonic waves 120 may be generated by the piezoelectric actuator 102 along the principal axis P towards a fluid outlet 108. A working fluid supply provides a working fluid 104 into a nozzle chamber 118 of the device 100 through a fluid inlet 106 at a side of the device 100 in a direction perpendicular to the principal axis P. The working fluid 104 crosses the path of the waves 120 at an angle and absorbs the vibrational energy transmitted by the waves 120. The energy in the working fluid 104 is thus enhanced and the working fluid 104 is now energized to form an actuated working fluid 110 which changes its direction of movement 116 in the nozzle chamber 118 before being discharged through the fluid outlet 108 of the nozzle chamber 118.

Examples of prior art cleaning nozzles which utilize the principles of the aforesaid conventional nozzle device 100 are Japanese Publication Number JP2003340330 (A) entitled "Ultrasonic Cleaning Nozzle, Apparatus Thereof and Semiconductor Device" and U.S. Pat. No. 5,927,306 entitled "Ultrasonic Vibrator, Ultrasonic Cleaning Nozzle, Ultrasonic Cleaning Device, Substrate Cleaning Device, Substrate Cleaning Treatment System And Ultrasonic Cleaning Nozzle Manufacturing Method". In both of these publications, ultrasonic cleaning nozzles are disclosed in which cleaning fluid enters a nozzle chamber at right angles to the direction of propagation of an ultrasonic wave.

However, there are shortcomings in such conventional ultrasonic or megasonic nozzle devices 100. As the working fluid 104 is introduced into the nozzle device 100 in a direction perpendicular to the direction of propagation of the high frequency waves 120, the waves 120 are distorted by the flow of the working fluid 104. A significant amount of vibrational energy of the high frequency waves 120 is lost as a result, which reduces the vibrational energy transmitted from the waves 120 to the working fluid 104. This decreases the cleaning and cooling effect of the nozzle device 100.

Furthermore, there is a sudden directional change of the working fluid 104 at a wave generation side 112 of the piezoelectric actuator 102. This creates a turbulent flow 114 which introduces an air barrier between the piezoelectric actuator 102 and the working fluid 104. Therefore, the efficiency of transmission of vibrational energy from the high frequency waves 120 to the working fluid 104 decreases. The turbulent flow 114 also affects the communication between the piezoelectric actuator 102 and the working fluid 104 which impedes the propagation of the waves 120 through the working fluid 104. The working fluid 104 is also less efficient in carrying away the heat generated by the piezoelectric actuator 102 due to the turbulent flow 114. Hence, excessive heat generated by the piezoelectric actuator 102 may shorten the lifespan of the piezoelectric actuator 102.

It would be desirable to increase the working efficiency of a nozzle device for cooling, cleaning and/or lubricating during machining by aligning the flow of the working fluid 104 with the direction of propagation of the high frequency waves 120.

SUMMARY OF THE INVENTION

It is thus an object of this invention to seek to provide an improved nozzle device in which the transmission of vibrational energy to the fluid projected therefrom is more efficient as compared to the prior art.

Accordingly, the invention provides a nozzle device comprising: a nozzle chamber; a fluid inlet located at a first side of the nozzle chamber which is operative to introduce fluid into the nozzle chamber in an injection direction; a fluid outlet at a second side of the nozzle chamber which is operative to expel fluid from the nozzle chamber; a high frequency wave generator located in the nozzle chamber which is oriented and operative to generate high frequency waves in a direction which is substantially parallel to the injection direction, whereby to impart high frequency energy to the fluid in the nozzle chamber.

It would be convenient hereinafter to describe the invention in greater detail by reference to the accompanying drawings which illustrate preferred embodiments of the invention. The particularity of the drawings and the related description is not to be understood as superseding the generality of the broad identification of the invention as defined by the claims.

BRIEF DESCRIPTION OF THE DRAWINGS

The present invention will be readily appreciated by reference to the detailed description of the preferred embodiments of the invention when considered with the accompanying drawings, in which.

DETAILED DESCRIPTION OF THE PREFERRED EMBODIMENTS OF THE INVENTION

The preferred embodiments of the present invention will be described hereinafter with reference to the accompanying drawings.

Figure 1:
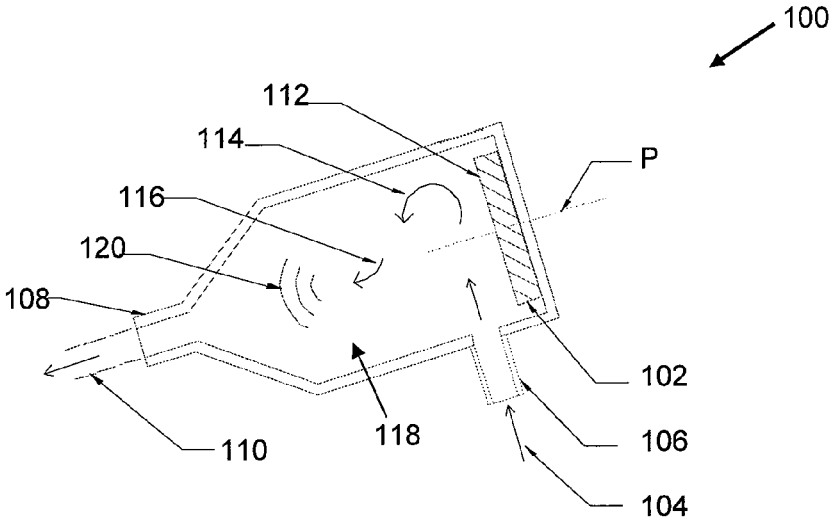
FIG. 1 (Prior Art)
FIG. 1 is a sectional view of a conventional nozzle device which illustrates a fluid being introduced into the nozzle device from a side of the device.
Figure 2:
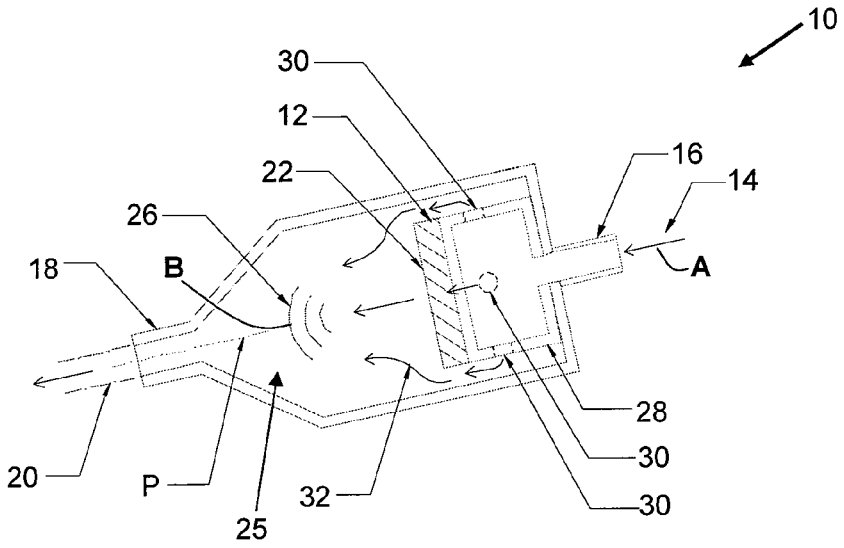
FIG. 2 is a sectional view of a nozzle device according to the first preferred embodiment of the invention.

FIG. 2 is a sectional view of a nozzle device 10 according to the first preferred embodiment of the invention. A fluid inlet 16 is located at a first side of the nozzle device 10 at the rear of a nozzle chamber 25 comprised in the nozzle device 10 and introduces a working fluid 14 into the nozzle chamber 25 in an injection direction, A. A diffuser 28 is located in the nozzle chamber 25 and comprises a peripheral wall surrounding the fluid inlet 16. It has an enclosed compartment to receive the working fluid 14 and to spread the working fluid 14 from the compartment into the nozzle chamber 25.

Apertures 30 formed in the peripheral wall of the diffuser 28 spread the working fluid 14 into the nozzle chamber 25 in directions which are substantially perpendicular to the injection direction. The working fluid 14 is then propagated along the nozzle chamber 25 towards a fluid outlet 18 in directions which are substantially parallel to the injection direction A. The fluid inlet 16 and the fluid outlet 18 may both be located along a principal axis P of the nozzle device 10.

A high frequency wave generator, such as a piezoelectric actuator 12, is mounted onto a wall of the diffuser 28 in the nozzle chamber 25 at a position which is interposed between the fluid inlet 16 and the fluid outlet 18. The wall may be a forward wall facing the fluid outlet 18 located at a second side of the nozzle device 10 which is directly opposite to and facing the first side of the nozzle device 10. The piezoelectric actuator 12 is oriented to generate high frequency waves 26, which are preferably waves in the megasonic frequency range, in a direction B which is substantially parallel to the injection direction A of the working fluid 14. This high frequency energy is then imparted to a working fluid flow 32 entering the nozzle chamber 25 from the diffuser 28 and propagates alongside the piezoelectric actuator 12 substantially parallel to the principal axis P and the injection direction A.

As the working fluid 14 is propagated generally in the same direction B of the high frequency waves 26, the loss of high frequency energy during the transmission of energy from the high frequency waves 26 to the working fluid flow 32 can be minimized. A jet of actuated working fluid 20 with enhanced energy can therefore be expelled from the nozzle chamber 25 through the fluid outlet 18 towards a working surface for cleaning the surface and clearing debris. The actuated working fluid 20 is also a more efficient coolant and/or lubricating agent as a result of the enhanced actuation energy.

Figure 3:
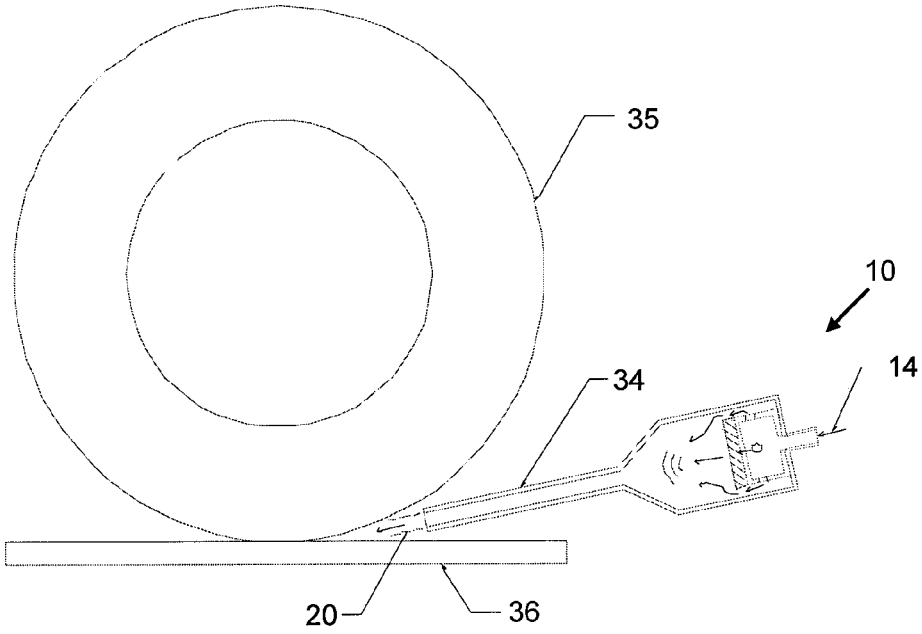
FIG. 3 is a sectional view of the nozzle device incorporating a nozzle with an extended length for cleaning debris from a working surface of a substrate.

FIG. 3 is a sectional view of the nozzle device 10 incorporating a nozzle 34 with an extended length for cleaning debris from a working surface of a substrate 36. The length of the elongated nozzle 34 depends on operational requirements and in the preferred embodiment is longer than or equal to a length of the nozzle chamber 25. The elongated nozzle 34 connects a position of the nozzle chamber 25 to a distant position adjacent to a working point where the working fluid 14 is to be directed, and is therefore especially advantageous for use at locations where there are spatial constraints in accommodating the body of the nozzle device 10.

In FIG. 3, the elongated nozzle 34 is sufficiently long to reach the proximity of the cuffing point of a rotary cutting blade 35 so that the actuated working fluid 20 can be projected more precisely towards the cutting point to remove debris resulting from cutting a semiconductor substrate 36. The actuated working fluid 20 also serves as an effective coolant agent for removing the heat generated by the rotating cutting blade 35 and the substrate 36 during sawing. The actuated working fluid 20 which is obtained by superimposing the vibrational energy having a high acoustic intensity with the energy of the working fluid 14 also functions as an efficient lubricating agent since it is able to remove debris which adheres to the rotary cutting blade 35 and the saw kerf. Cuts of an improved cutting quality can thus be obtained and the lifespan of the rotary cutting blade 35 is prolonged.

Further, the actuated working fluid 20 is an effective cleaning agent to remove the contaminants attached to the surface of the substrate 36. As the cutting and cleaning processes are performed at the same time instead of separately, the overall throughput of a sawing machine incorporating this megasonic nozzle device 10 increases.

Figure 4:
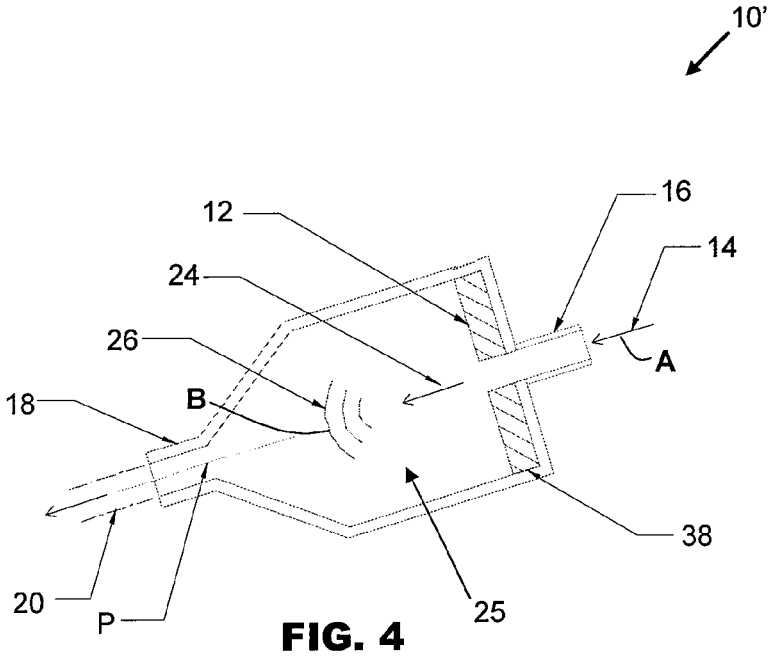
FIG. 4 is a sectional view of a nozzle device according to the second preferred embodiment of the invention.

FIG. 4 is a sectional view of a nozzle device 10' according to the second preferred embodiment of the invention. The device 10' comprises a piezoelectric actuator 38 mounted onto a first side of the nozzle device 10' at the rear of the nozzle chamber 25. The piezoelectric actuator 38 is ring-shaped and has an aperture at its center which is in communication with the fluid inlet 16 for the working fluid 14 to flow from the fluid inlet 16 into the nozzle chamber 25 through the said aperture. The working fluid 14 flows through the nozzle chamber 25 towards the fluid outlet 18 located along the principal axis P of the nozzle device 10'. As such, the injection direction A of the working fluid 14 is substantially parallel to the direction B of propagation of the high frequency waves 26 which are generated by the piezoelectric actuator 12. The degree of distortion of the high frequency waves 26 due to the directional flow of the working fluid 14, as well as the formation of turbulent flows inside the nozzle device 10', is reduced. Thus, the performance of the megasonic nozzle device 10' for cooling and cleaning a working surface is improved.

It should be appreciated that the nozzle devices 10, 10' according to the preferred embodiments of the invention align the direction of flow of the working fluid 14 with the propagation of the high frequency waves 26 generated by the piezoelectric actuator 12. In this way, the propagation of the high frequency waves 26 has minimal distortion as compared to the prior art nozzle devices and energy loss during the transmission of the high frequency energy to the working fluid 14 is reduced. Accordingly, the cleaning and cooling efficiency of the nozzle device can be improved. Moreover, sudden changes in the direction of flow of the working fluid 14 at the wave generation side 22 of the piezoelectric actuator 12 are largely avoided so that there is less likelihood of forming a turbulent flow or creating an air barrier between the piezoelectric actuator 12 and the working fluid 14. The lifespan of the piezoelectric actuator 12 is prolonged as a result of a reduction in turbulence in the nozzle chamber 25.

The invention described herein is susceptible to variations, modifications and/or additions other than those specifically described and it is to be understood that the invention includes all such variations, modifications and/or additions which fall within the spirit and scope of the above description.

The invention claimed is:

1. A nozzle device comprising:

a nozzle chamber;

a fluid inlet located at a first side of the nozzle chamber which is configured to introduce fluid into the nozzle chamber in an injection direction;

a fluid outlet at a second side of the nozzle chamber which is configured to expel fluid from the nozzle chamber;

a high frequency wave generator located in the nozzle chamber which is configured to generate high frequency waves in a direction which is substantially parallel to the injection direction, whereby to impart high frequency energy to the fluid in the nozzle chamber, wherein the nozzle chamber further comprises a diffuser having a compartment to receive fluid injected by the fluid inlet, and which is configured to spread the fluid from the compartment into the nozzle chamber, and wherein the diffuser further comprises a peripheral wall surrounding the fluid inlet, apertures being formed in the peripheral wall which are configured to spread the fluid into the nozzle chamber in directions which are substantially perpendicular to the injection direction.

2. The nozzle device as claimed in claim 1, wherein the nozzle chamber further comprises a diffuser having a compartment to receive fluid injected by the fluid inlet, and which is configured to spread the fluid from the compartment into the nozzle chamber.

3. The nozzle device as claimed in claim 2, wherein the high frequency wave generator is mounted onto a wall of the diffuser at a position which is interposed between the fluid inlet and the fluid outlet.

4. The nozzle device as claimed in claim 1, wherein the fluid which is spread into the nozzle chamber is propagated along the nozzle chamber towards the fluid outlet in directions which are substantially parallel to the injection direction.

5. The nozzle device as claimed in claim 1, wherein the fluid outlet further comprises an elongated nozzle extending from the nozzle chamber to a position adjacent to a working point where the fluid is to be directed, and wherein a length of the elongated nozzle is longer than or equal to a length of the nozzle chamber.

6. The nozzle device as claimed in claim 1, wherein the second side of the nozzle chamber is directly opposite to and facing the first side of the nozzle chamber.

7. The nozzle device as claimed in claim 6, wherein the fluid inlet and the fluid outlet are both located along the same axis.

8. The nozzle device as claimed in claim 1, wherein the high frequency wave generator is mounted onto the first side of the nozzle chamber.

9. The nozzle device as claimed in claim 8, wherein the high frequency wave generator has an aperture therein in communication with the fluid inlet for allowing fluid to flow from the fluid inlet into the nozzle chamber through the aperture.

10. The nozzle device as claimed in claim 8, wherein the high frequency wave generator is ring-shaped.

11. The nozzle device as claimed in claim 1, wherein the high frequency wave generator comprises a piezoelectric actuator.

12. The nozzle device as claimed in claim 1, wherein the high frequency wave generator is configured to generate waves in the megasonic frequency range.

* * * * *